US007434518B2

(12) United States Patent
Dunham

(10) Patent No.: US 7,434,518 B2
(45) Date of Patent: Oct. 14, 2008

(54) TWO-PIECE MODEL RAILROAD TRUCK FRAME

(75) Inventor: Michael Nathan Dunham, Central Point, OR (US)

(73) Assignee: Kadee Quality Products, White City, OR (US)

( * ) Notice: Subject to any disclaimer, the term of this patent is extended or adjusted under 35 U.S.C. 154(b) by 213 days.

(21) Appl. No.: 11/604,472

(22) Filed: Nov. 27, 2006

(65) Prior Publication Data

US 2008/0121135 A1 May 29, 2008

(51) Int. Cl.
*B61F 1/00* (2006.01)
*B61D 15/00* (2006.01)
*B61D 17/00* (2006.01)

(52) U.S. Cl. ..... 105/157.2; 105/1.5; 105/157.1

(58) Field of Classification Search ..... 105/1.5, 105/157.1, 157.2, 226, 227, 228, 229, 230; 213/75 TC See application file for complete search history.

(56) References Cited

U.S. PATENT DOCUMENTS

| | | | | | |
|---|---|---|---|---|---|
| 4,799,431 | A * | 1/1989 | Edwards et al. | ..... | 105/1.5 |
| 5,090,332 | A * | 2/1992 | Edwards et al. | ..... | 105/157.2 |
| 5,768,999 | A * | 6/1998 | Edwards | ..... | 105/157.2 |
| 5,832,837 | A * | 11/1998 | Edwards | ..... | 105/157.2 |
| 2004/0255816 | A1 * | 12/2004 | Chenier | ..... | 105/157.2 |
| 2008/0121135 | A1 * | 5/2008 | Dunham | ..... | 105/1.5 |

* cited by examiner

*Primary Examiner*—Mark T Le
*Assistant Examiner*—Jason C Smith
(74) *Attorney, Agent, or Firm*—Robert D. Varitz, PC

(57) ABSTRACT

A truck for use on a piece of model railroad rolling stock, the truck having axle/wheels sets associated therewith includes two identical truck portions, which, when joined, form a model railroad truck frame, which is held together by mechanical impedance by a frame retainer located in a central mounting structure formed by joining the two truck portions.

10 Claims, 2 Drawing Sheets

Fig. 3
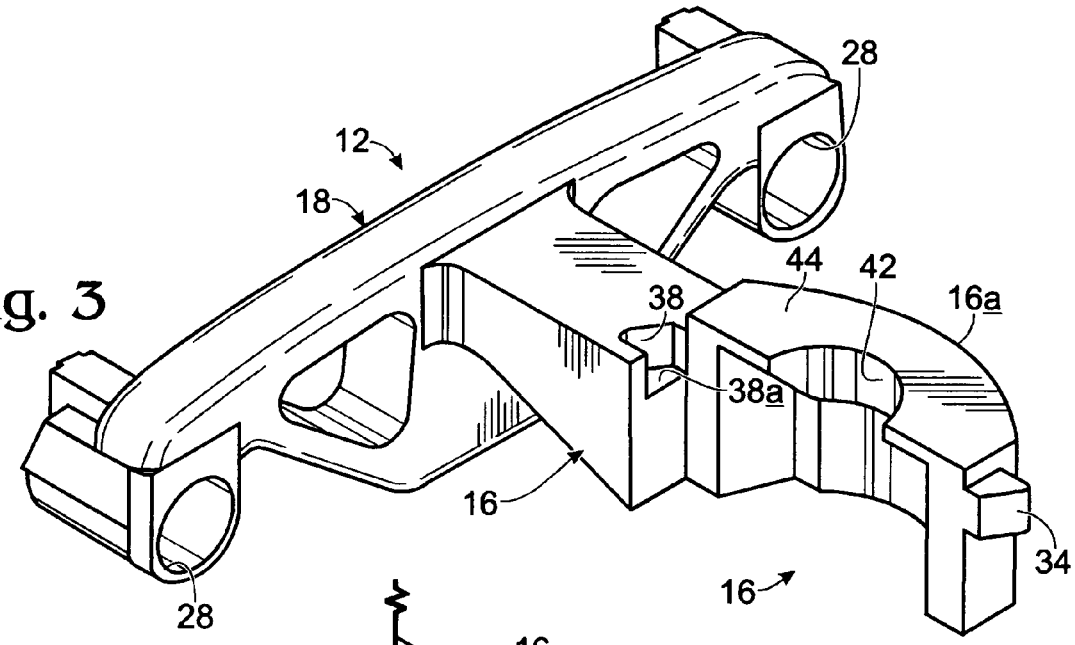
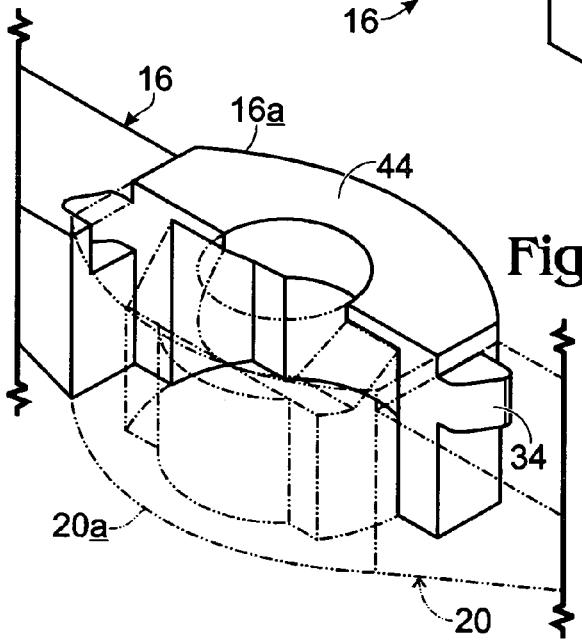
Fig. 5
Fig. 4
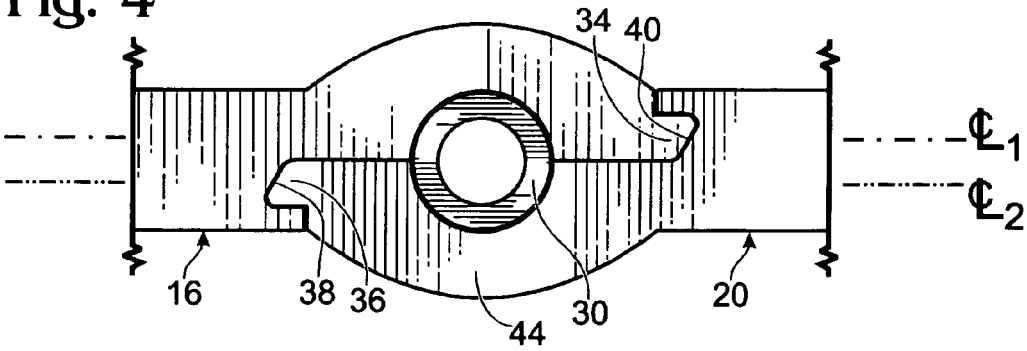

TWO-PIECE MODEL RAILROAD TRUCK FRAME

FIELD OF THE INVENTION

This invention relates to model railroads, and specifically to a two-piece truck frame for use on model railroad rolling stock.

BACKGROUND OF THE INVENTION

Trucks that are used on model railroad rolling stock are scaled-down versions of prototypical railroad trucks. Although the framework for some trucks are formed as a one-piece structure, most trucks used by serious model railroaders include a separate truck bolster and spaced-apart side frames, wherein the bolsters are held in the side frames by means of springs, which allow a side frame to move torsionally relative to the bolster and to the other side frame. Wheel sets for each truck, including an axle having a wheel at each end thereof, are contained within journal boxes, which are located in the side frames. The flexible nature of the multi-piece truck allows the wheel sets to follow irregularities in the track, thereby maintaining the truck, and in turn, the rolling stock, on the track.

Known flexible trucks are quite difficult to assemble because the springs, which hold the truck elements together, are essentially free-floating, i.e., they are not secured to either the bolster or the side frame, and are usually captured to prevent lateral movement of the springs by protrusions which extend from the bolster and side frames. The springs used in both prototypical and model railroad trucks are usually coil springs, which extend between the end of a bolster and a truck side frame. In some instances, leaf springs may be used in prototypical trucks. Coil springs used in model railroad trucks are typically less than 0.16 cm in diameter and approximately 0.3 cm in non-compressed length. They are most difficult to handle. Although the use of a specialized pics may assist a model railroader with the insertion of springs into a truck assembly, the assembly of a conventional truck still requires that each individual spring be placed between the bolster and side frame. Generally, four springs are provided, two associated with each end of the bolster. Such assembly does not lend itself to any type of automation, and further, requires delicate manual assembly of the truck assembly, a task which produces stress in the hands and eyes of the assembly worker, and also results in increased manufacturing costs. Examples of a truck and an assembly technique which eliminate some of these concerns are found in U.S. Pat. No. 5,768,999 for Model Railroad Truck, granted to Edwards on Jun. 23, 1998, and U.S. Pat. No. 5,832,837 for Method of Assembling a Model Railroad Truck, granted to Edwards on Nov. 10, 1998.

Springs as provided on model railroad trucks provide for torsional movement of a truck side frame relative to a truck bolster, but do not really compress to provide cushioning for the rolling stock to which they are mounted. Torsion from side-to-side of a truck is important to enable the truck to pass over uneven trackwork, frogs and switch points. One solution used is to provide wheel sets with larger-than-scale flanges on the wheels, however this is highly objectionable to the serious model railroader. Another problem inherent in conventional sprung trucks is side frame toe out, which can actually lead to derailment.

Perhaps the most serious objection to the use of discrete springs in model railroad trucks is that the springs are not to scale. A prototype truck may have two or more large coil springs, or plural leaf springs, located between the bolster and the side frame, however, such springs are massive, and likely have a cross section of between two and three inches. The coil springs used on models are much finer, and, if converted to prototype scale, would have a diameter of less than half an inch, and would be non-functional in a prototypical world at this size.

BRIEF SUMMARY OF THE INVENTION

A truck for use on a piece of model railroad rolling stock, the truck having axle/wheels sets associated therewith includes two identical truck portions, which, when joined, form a model railroad truck frame, each truck portion including a half bolster, including a half central mounting structure, a slot located adjacent said half central mounting structure inboard thereof and a tongue located adjacent said half central mounting structure outboard thereof; and a side frame; wherein, when a tongue on one truck portion is placed in the slot of another truck portion, a truck frame is formed; and a frame retainer which is received in a full central mounting structure, formed by the half central mounting structures of two truck portions with the truck portions joined; wherein, with the frame retainer received in said full central mounting structure, the frame portions are (1) prevented from laterally separating from one another, and (2) have a limited rotational movement relative one another along axes extending through each slot-tongue combination.

It is an object of the invention to provide a model railroad truck structure which lends itself to automatic assembly of the truck structure.

Another object of the invention is to provide a model railroad truck which has a prototypical appearance, but which does not require the use of discrete springs between a truck bolster and a truck side frame.

A further object of the invention is to provide a model railroad truck which contains minimal components.

These and other objects and advantages of the invention will become more fully apparent as the description which follows is read in conjunction with the drawings.

BRIEF DESCRIPTION OF THE DRAWING

FIG. 3 is a perspective view of a truck frame portion.

FIG. 4 is a partial top plan view of two truck frame portions joined together.

FIG. 5 is a perspective view of a central mounting structure of the model railroad truck.

DETAILED DESCRIPTION OF THE PREFERRED EMBODIMENTS

The truck of the invention includes a two-piece interlocking frame having free floating torsion suspension. It may be secured to a car by any of a standard bolster pivot screw, a shoulder screw, a specialized frame retainer, or the Kadee® self-centering bolster pivot bushing, described in U.S. Pat. No. 5,090,332, granted to Edwards et al., on Feb. 25, 1992. Free floating torsion suspension provides reliable tracking by an exerting equal downward force on all wheels, even when traveling over uneven track-work, switches and frogs. With free floating torsion suspension a more prototypical wheel may be used, having wheel flanges which are more scale-like in appearance.

Figure 1:
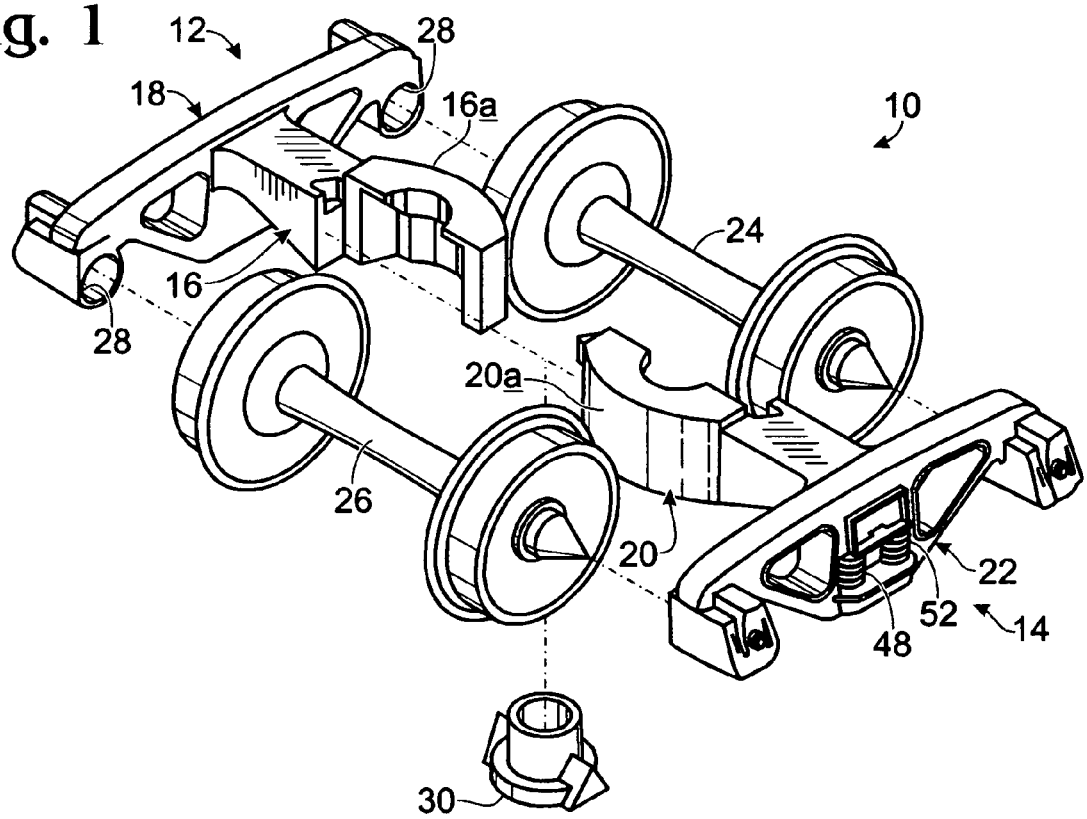
FIG. 1 is an exploded perspective view of the components of the model railroad truck of the invention.
Figure 2:
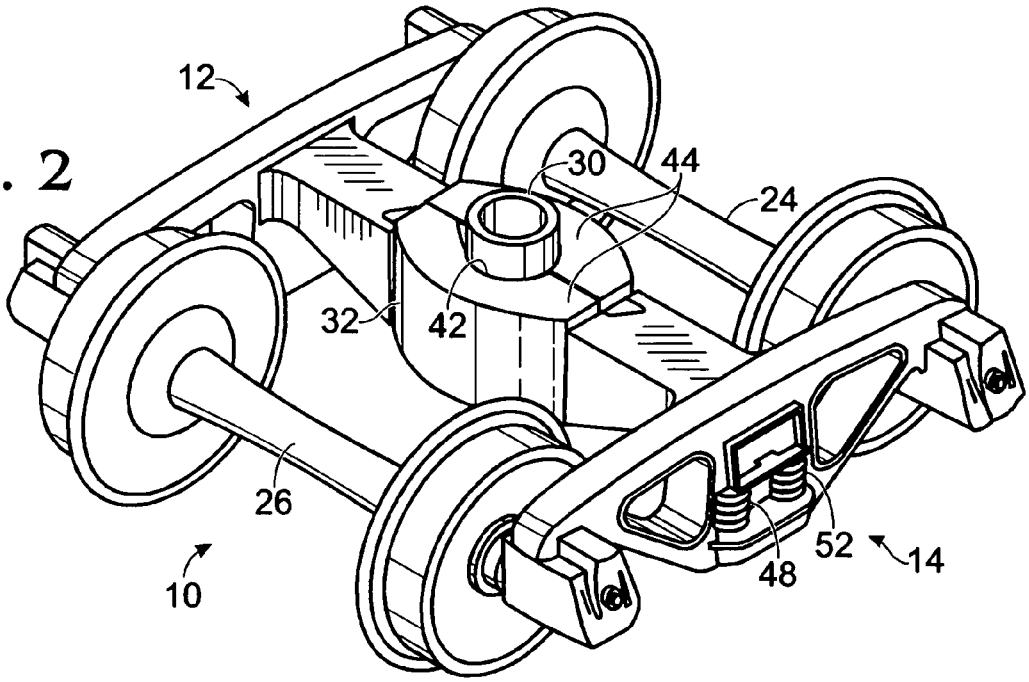
FIG. 2 is a perspective view of the assembled model railroad truck.

Referring initially to FIGS. 1 and 2, the two-piece model railroad truck of the invention is depicted generally at 10. Truck 10 includes a pair of truck portions, shown at 12 and 14. Portions 12 and 14 are identically formed pieces, which may be formed by casting, injection molding, etc. Each portion, and now referring to portion 12, includes a half bolster 16 and a side frame 18. For the sake of clarity, the figures are labeled with reference numbers for portion 14, which includes a half bolster 20 and a side frame 22. Each half bolster includes a half central mounting structure, 16*a*, 20*a*.

Joined with the truck portions are a pair of axle/wheel sets 24, 26. The ends of the axles are received in journals in the side frame portions, for example, journals 28 in side frame portion 18.

A frame retainer 30 is provided, which is functional (1) to hold the two truck portions together, and (2) to fasten the truck to a model railroad car. Frame retainer 30 may take the form of a sleeve and a screw or bolt fastener, or may be the self-centering device of U.S. Pat. No. 5,090,332.

As shown in FIG. 2, joined half bolsters 16, 20 form a central mounting structure 32, which receives retainer 30 therein. Referring now to FIGS. 3-5, the half central mounting structures 16*a*, 20*a*, includes, respectively, a tongue 34, 36, formed on the outboard side thereof, and, on the other side of the half central mounting structure, a slot 38, 40, formed on the inboard side thereof. Slots 38, 40, have a slot shelf 38*a*, 40*a*, respectively, at the base thereof. The tongue on one truck portion is laterally inserted into the slot on the other truck portion, with the axle/wheels sets inserted into the journals, which also places the tongue on the other truck portion into the slot on the one truck portion. When retainer 30 is inserted into the complete central mounting structure, formed by the two half central mounting structures, lateral separation of the truck portions is inhibited, thus holding the two identically formed truck portions together with the axle/wheel sets, forming a completed truck. The two piece truck interlocking design holds the two truck halves together by mechanical impedance.

The slots receive their respective tongues, and with the pivot bushing installed the components become interlocked to construct the floating torsion suspension truck. This two piece interlocking design allows each bolster/side frame to twist independently from the other about a C/L axis created between the thumbs and their respective slot until the assemblage reaches its limit of travel. This travel limit keeps the mechanism from rotating to the point that the axle tips could slip past the confines of the journals, enabling the axle/wheel assemblage to separate from the truck. When the truck of the invention is assembled and installed on a model railroad car, and a load applied to upper surface 44 of central mounting structure 32, the load is carried by tongues 34, 36 of each truck portion on slot shelf 40*a*, 38*a*, respectively, also referred to herein as slot-tongue combinations, and then transferred through side frames to journals 28 and axle/wheel sets 24, 26.

The interior of central mounting structure 32 includes a hole 42 in the upper surface 44 thereof to allow passage of retainer 30 and an associated fastener, thereby securing the truck to a model railroad car. If truck 10 is configured to work under U.S. Pat. No. 5,090,332, provision is made for vertical movement of the truck along frame retainer 30 for self-centering, which includes providing a notch (not shown) on the underside of upper surface 44. A cavity 46 is formed in the full central mounting structure to fully capture any form of frame retainer 30.

Another feature of the invention is that the truck portions are fabricated so that, when the truck portions are joined, there is a slight amount of play between the two truck portions, which allows limited rotational movement of the truck portions relative to one another, along the two lines indicated $C/L_1$ and $C/L_2$, shown in FIG. 4. In the preferred embodiment, there is approximately a 0.005 inch clearance between frame retainer 30 and hole 42, allowing for rotation of the truck relative to frame retainer 30 and for torsional movement of truck portions 12, 14 relative one another. The allowed torsional movement is not sufficient to allow lateral movement of the truck portions relative one another such that the tongues slip out of their respective slots.

The construction of the truck of the invention, while very different from conventional spring-containing model railroad trucks, provides for characteristics much like those of traditional spring-containing model railroad trucks, which allows for passage of a truck over an uneven section of track because the two truck portions are able to flex relative one another, thus curtailing the incidence of derailments. To maintain a prototypical appearance, "springs" 48, 50 are integrally formed with the truck portions, which are formed by injection molding. Thus, the difficult fabrication step of installing coil springs in the trucks is eliminated, and the integrally molded springs 48, 50 may be sized to be precise scale models of the prototypical springs found on full-scale railroad rolling stock.

The truck of the invention provides improved rolling characteristics, more prototypical appearance, fewer parts and quicker assembly, which assembly may be accomplished by mechanical devices rather than by manual manipulation. For example, the axle/wheel sets may be automatically placed in a jig to provide proper spacing therebetween; the two truck portions may be shifter laterally towards one another, capturing the axle/wheel sets, and the retainer inserted, thus securing all components in an operable condition. All of these steps may be easily performed by automated processes, significantly reducing fabrication costs.

Although a preferred embodiment of the invention has been disclosed herein, it should be appreciated that further variation and modifications may be made thereto without departing from the scope of the invention as defined in the appended claims.

I claim:

1. A truck for use on a piece of model railroad rolling stock, the truck having axle/wheels sets associated therewith, comprising:

two identical truck portions, which, when joined, form a model railroad truck frame, each truck portion comprising:

a half bolster, including a half central mounting structure, a slot located adjacent said half central mounting structure inboard thereof and a tongue located adjacent said half central mounting structure outboard thereof; and a side frame;

wherein, when said tongue on one truck portion is placed in the slot of another truck portion, said truck frame is formed; and a frame retainer which is received in a full central mounting structure, formed by the half central mounting structures of two truck portions with the truck portions joined;

wherein, with the frame retainer received in said full central mounting structure, the frame portions are (1) prevented from laterally separating from one another, and (2) have a limited rotational movement relative one another along axes extending through each slot-tongue combination.

2. The truck of claim 1 which includes journals in each side frame for receiving the axle/wheel sets therein for rotational capture.

3. The truck of claim 1 which includes molded, non-functional springs in each side frame, which springs are integrally formed with said truck portions.

4. The truck of claim 1 wherein said central mounting structure includes a hole for passage of said frame retainer and a fastener therethrough, to hold said truck portions together by mechanical impedance.

5. The truck of claim 1 wherein said central mounting structure has a cavity therein to retain and capture said frame retainer.

6. The truck of claim 1 wherein said cavity is constructed and arranged for self-centering of the truck relative to a model railroad car.

7. A truck for use on a piece of model railroad rolling stock, the truck having axle/wheels sets associated therewith, comprising:

two identical truck portions, which, when joined, form a model railroad truck frame, each truck portion comprising:

a half bolster, including a half central mounting structure, a slot located adjacent said half central mounting structure inboard thereof and a tongue located adjacent said half central mounting structure outboard thereof; and a side frame;

wherein, when said tongue on one truck portion is placed in the slot of another truck portion, said truck frame is formed; and a frame retainer which is received in a full central mounting structure, formed by the half central mounting structures of two truck portions with the truck portions joined, wherein said full central mounting structure includes a hole for passage of said frame retainer and a fastener therethrough, and wherein said central mounting structure further includes a cavity therein to retain and capture said frame retainer;

wherein, with the frame retainer received in said full central mounting structure, the frame portions are (1) prevented from laterally separating from one another by mechanical impedance, and (2) have a limited rotational movement relative one another along axes extending through each slot-tongue combination.

8. The truck of claim 7 which included journals in each side frame for receiving the axle/wheel sets therein for rotational capture.

9. The truck of claim 7 which includes molded, non-functional springs in each side frame, which springs are integrally formed with said truck portions.

10. The truck of claim 7 wherein said cavity is constructed and arranged for self-centering of the truck relative to a model railroad car.

* * * * *